US011359399B2

(12) United States Patent
Reyes et al.

(10) Patent No.: US 11,359,399 B2
(45) Date of Patent: Jun. 14, 2022

(54) METHODS FOR REINFORCING A STEALTH POLE

(71) Applicant: Tower Engineering Solutions, LLC, Las Vegas, NV (US)

(72) Inventors: Jaime Reyes, Grapevine, TX (US); Hanming You, Irving, TX (US); Robert Semaan, Aventura, FL (US)

(73) Assignee: Tower Engineering Solutions, LLC, Las Vegas, NV (US)

( * ) Notice: Subject to any disclaimer, the term of this patent is extended or adjusted under 35 U.S.C. 154(b) by 351 days.

(21) Appl. No.: 15/954,985

(22) Filed: Apr. 17, 2018

(65) Prior Publication Data

US 2018/0371783 A1 Dec. 27, 2018

Related U.S. Application Data

(60) Provisional application No. 62/608,729, filed on Dec. 21, 2017, provisional application No. 62/524,954, filed on Jun. 26, 2017.

(51) Int. Cl.
*E04H 12/16* (2006.01)
*H01Q 1/42* (2006.01)
(Continued)

(52) U.S. Cl.
CPC ..... *E04H 12/16* (2013.01); *E04H 12/003* (2013.01); *E04H 12/085* (2013.01); *H01Q 1/005* (2013.01);
(Continued)

(58) Field of Classification Search
CPC ..... E04H 12/00; E04H 12/08; E04H 12/16; E04H 12/22; H01Q 1/12; H01Q 12/1242
See application file for complete search history.

(56) References Cited

U.S. PATENT DOCUMENTS 1,786,631 A * 12/1930 Roe ..... H02G 7/00 52/223.5
3,571,991 A * 3/1971 Doocy ..... E04H 12/08 52/40
(Continued)

FOREIGN PATENT DOCUMENTS

CA 2997927 A1 * 3/2017 ..... E04H 12/16
EP 1341255 A1 9/2003
KR 101340625 B1 12/2013

OTHER PUBLICATIONS

International Patent Application No. PCT/US18/027894: Written Opinion dated Jul. 11, 2018, 5 pages.
(Continued)

*Primary Examiner* — Phi D A
(74) *Attorney, Agent, or Firm* — Quicker Law, LLC

(57) ABSTRACT

A stealth pole includes a plurality of canister sections, each of the plurality of canister sections including a spine, a first splice plate located on a first end of the spine, a second splice plate located on a second end of the spine, and a canister cover that covers the spine, the first splice plate and the second splice plate. A method for reinforcing the stealth pole includes removing the canister cover from at least one of the plurality of canister sections; attaching a plurality of stiffener members to the first splice plate and the second splice plate; and applying tension, compression or a combination thereof to the plurality of stiffener members. The plurality of stiffener members reinforce the spine of the canister section. A reinforced stealth pole is also described.

8 Claims, 8 Drawing Sheets

(51) Int. Cl.

| | |
|---|---|
| ***E04H 12/08*** | (2006.01) |
| ***E04H 12/00*** | (2006.01) |
| ***H01Q 1/00*** | (2006.01) |
| ***H01Q 1/12*** | (2006.01) |
| ***H01Q 1/24*** | (2006.01) |

(52) U.S. Cl.
CPC ..... *H01Q 1/1228* (2013.01); *H01Q 1/1242* (2013.01); *H01Q 1/246* (2013.01); *H01Q 1/42* (2013.01)

(56) References Cited

U.S. PATENT DOCUMENTS 4,196,551 A * 4/1980 Bondarenko ..... E04H 5/12 52/223.3
5,266,738 A * 11/1993 MacVoy ..... E04H 12/08 174/45 R
5,333,436 A * 8/1994 Noble ..... E04H 12/085 52/849
5,687,537 A * 11/1997 Noble ..... H01Q 1/1242 52/849
5,995,063 A * 11/1999 Somoza et al. ..... 52/40
6,694,698 B2 * 2/2004 Ryan ..... E04C 3/30 52/741.1
6,915,618 B2 * 7/2005 Payne ..... E02D 27/42 52/849
7,343,718 B2 * 3/2008 Foust ..... E04C 3/32 264/228
8,136,329 B2 * 3/2012 Willis ..... E04H 12/08 52/848
8,978,315 B2 * 3/2015 Lam ..... E04H 12/085 52/40
2002/0170261 A1 11/2002 Brunozzi, Jr. et al.
2002/0184833 A1 * 12/2002 Jones ..... E04B 12/00 52/40
2004/0139665 A1 7/2004 Ullrich et al.
2005/0007295 A1 1/2005 Janoschka et al.
2006/0196878 A1 9/2006 Cook
2009/0300996 A1 * 12/2009 Jones ..... E04C 3/30 52/40
2011/0140447 A1 * 6/2011 Paura ..... E04H 12/085 290/55
2011/0156984 A1 6/2011 Caldwell et al.
2013/0298496 A1 * 11/2013 Uebbing ..... F03D 13/10 52/745.18
2014/0053500 A1 2/2014 Janot
2014/0237909 A1 * 8/2014 Gupta ..... H01Q 1/1242 52/40
2015/0259907 A1 * 9/2015 Points ..... E04D 12/002 52/653.1
2018/0371783 A1 * 12/2018 Reyes ..... E04H 12/085

OTHER PUBLICATIONS

Extended European Search Report issued in European Application No. 18824838.9, dated Feb. 9, 2021, 8 pages.
International Search Report for International Application No. PCT/US18/027894 dated Jul. 11, 2018, 3 pages.

* cited by examiner

METHODS FOR REINFORCING A STEALTH POLE

RELATED APPLICATIONS

The present application claims the benefit of U.S. Provisional Application No. 62/524,954, filed Jun. 26, 2017, entitled "Methods for reinforcing a stealth pole" and U.S. Provisional Application No. 62/608,729, filed Dec. 21, 2017, entitled "Methods for reinforcing a stealth pole." The disclosures of each of these applications are incorporated herein by this reference in their entireties.

FIELD OF THE DISCLOSURE

The present disclosure relates to telecommunications poles, and in particular to stealth poles that include a plurality of stiffener members that reinforce the stealth pole.

BACKGROUND OF THE DISCLOSURE

Wireless networks for mobile communications primarily rely on macro tower sites to transmit RF signals. These sites typically utilize one of three structure types: self-supporting, guyed and monopole structures. Monopole structures are used more widely in densely populated urban areas, while the self-supporting and guyed towers are used in more rural areas due to the larger land requirement.

Monopole structures have a more slimmed-down appearance and as a result are more readily accepted by the public and by local jurisdictions. Often, however, jurisdictions still require these monopole structures to be disguised or camouflaged to reduce their visibility. These are called "stealth" structures/poles and are often required to support flags or to be constructed in the shape of trees, palm trees or even cacti.

These stealth structures are typically designed as simple steel poles supporting multi-level communication canisters. These canisters include a slender steel support spine encased by an RF transparent canister cover/shroud. The wireless antennas and other equipment are housed inside the canisters and mounted to the internal spine.

The size of the canisters is determined by the quantity and size of antennas and equipment being installed. Currently, tens of thousands of stealth structures have been installed nationwide and have performed well. It is often necessary, however, to upgrade the stealth structure in order to install Carrier network upgrades. These upgrades may require new and larger antennas to be installed, which is problematic for stealth structures due to the limited internal canister space.

One solution when the new antennas and equipment does not fit in the available canister has been to enlarge the canister. Unfortunately, it is not uncommon for the internal spine of these enlarged canisters to fail due to excessive loading on the stealth structure. Wind forces can also contribute to failure of individual canister sections and/or the stealth structure. In particular, wind-induced vortex shedding—in which a smooth cylindrical structure (such as the stealth pole or even a smoke stack/chimney) develops a low pressure area on the side of the structure opposite the wind force (similar to the phenomena that results in lift over the wing of an aircraft)—can occur. Vortex shedding causes movement of the structure perpendicular to the direction of the wind and toward the low pressure area. When the critical wind speed of the structure is reached, the forces can cause the structure to resonate, resulting in large forces and deflections. Wind-induced vortex shedding, and in some cases overloading of the canister(s), has caused failure of the internal spine of the canister in numerous installations, requiring removal/replacement or modification of the canister. This results in down-time and increased costs for all existing Carriers that have equipment located on the stealth pole as the Carrier equipment is removed and temporarily relocated while the canisters are being replaced or modified.

These and other shortcomings are addressed by aspects of the present disclosure.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

SUMMARY

Figure 1:
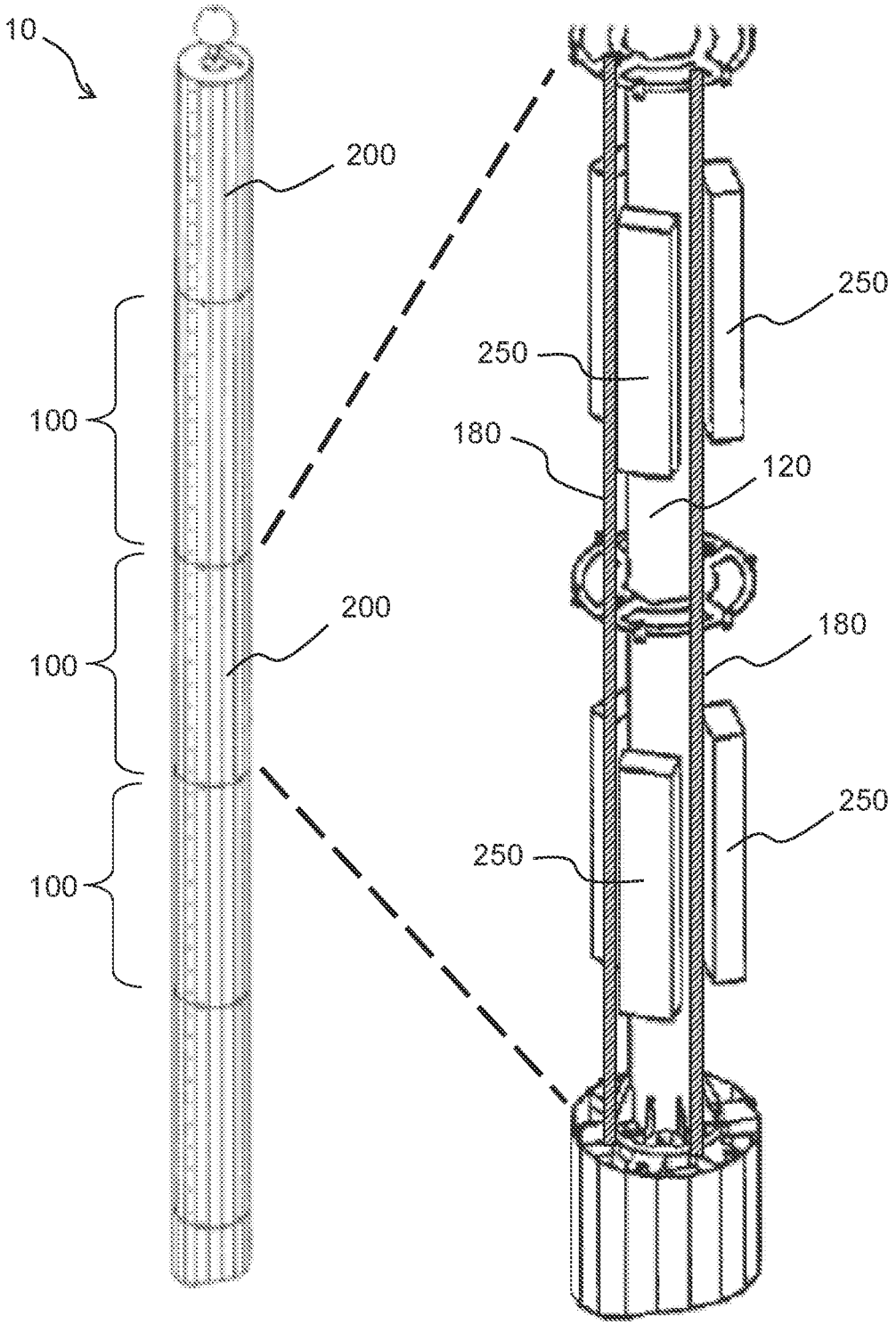
FIG. 1 is a side perspective view of a stealth pole according to an aspect of the disclosure.

Aspects of the disclosure relate to a method for reinforcing a stealth pole, the stealth pole including a plurality of canister sections, each of the plurality of canister sections including: a spine; a first splice plate located on a first end of the spine; a second splice plate located on a second end of the spine; and a first canister cover that covers the spine, the first splice plate and the second splice plate. The method includes: removing the first canister cover from at least one of the plurality of canister sections; attaching a plurality of stiffener members to the first splice plate and the second splice plate; and applying tension, compression or a combination thereof to the plurality of stiffener members. The plurality of stiffener members reinforce the spine of the canister section.

Aspects of the disclosure further relate to a stealth pole including: a plurality of canister sections, each of the plurality of canister sections including a spine, a first splice plate located on a first end of the spine, a second splice plate located on a second end of the spine; and a plurality of stiffener members attached to the first splice plate and the second splice plate. Tension, compression or a combination thereof is applied to the plurality of stiffener members, and the plurality of stiffener members reinforce the spine.

DETAILED DESCRIPTION

The present disclosure can be understood more readily by reference to the following detailed description of the disclosure and the Examples included therein. In various aspects, the present disclosure relates to a stealth pole including a plurality of canister sections, each of the plurality of canister sections including a spine, a first splice plate located on a first end of the spine, a second splice plate located on a second end of the spine, and a canister cover that covers the spine, the first splice plate and the second splice plate. A method for reinforcing the stealth pole includes removing the canister cover from at least one of the plurality of canister sections; attaching a plurality of stiffener members to the first splice plate and the second splice plate; and applying tension, compression or a combination thereof to the plurality of stiffener members. The plurality of stiffener members reinforce the spine of the canister section. A reinforced stealth pole is also described.

Before the present articles, systems, devices, and/or methods are disclosed and described, it is to be understood that they are not limited to specific synthetic methods unless otherwise specified, or to particular components unless otherwise specified, as such can, of course, vary. It is also to be understood that the terminology used herein is for the purpose of describing particular aspects only and is not intended to be limiting.

Various combinations of elements of this disclosure are encompassed by this disclosure, e.g., combinations of elements from dependent claims that depend upon the same independent claim.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

All publications mentioned herein are incorporated herein by reference to disclose and describe the methods and/or materials in connection with which the publications are cited.

Definitions

It is also to be understood that the terminology used herein is for the purpose of describing particular aspects only and is not intended to be limiting. As used in the specification and in the claims, the term "comprising" can include the embodiments "consisting of" and "consisting essentially of" Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to a structure including "a stiffener member" includes structures having two or more stiffener members.

Ranges can be expressed herein as from one value (first value) to another value (second value). When such a range is expressed, the range includes in some aspects one or both of the first value and the second value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the designated value, approximately the designated value, or about the same as the designated value. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

Unless otherwise stated to the contrary herein, all test standards are the most recent standard in effect at the time of filing this application.

Methods for Reinforcing a Stealth Pole

Figure 2:
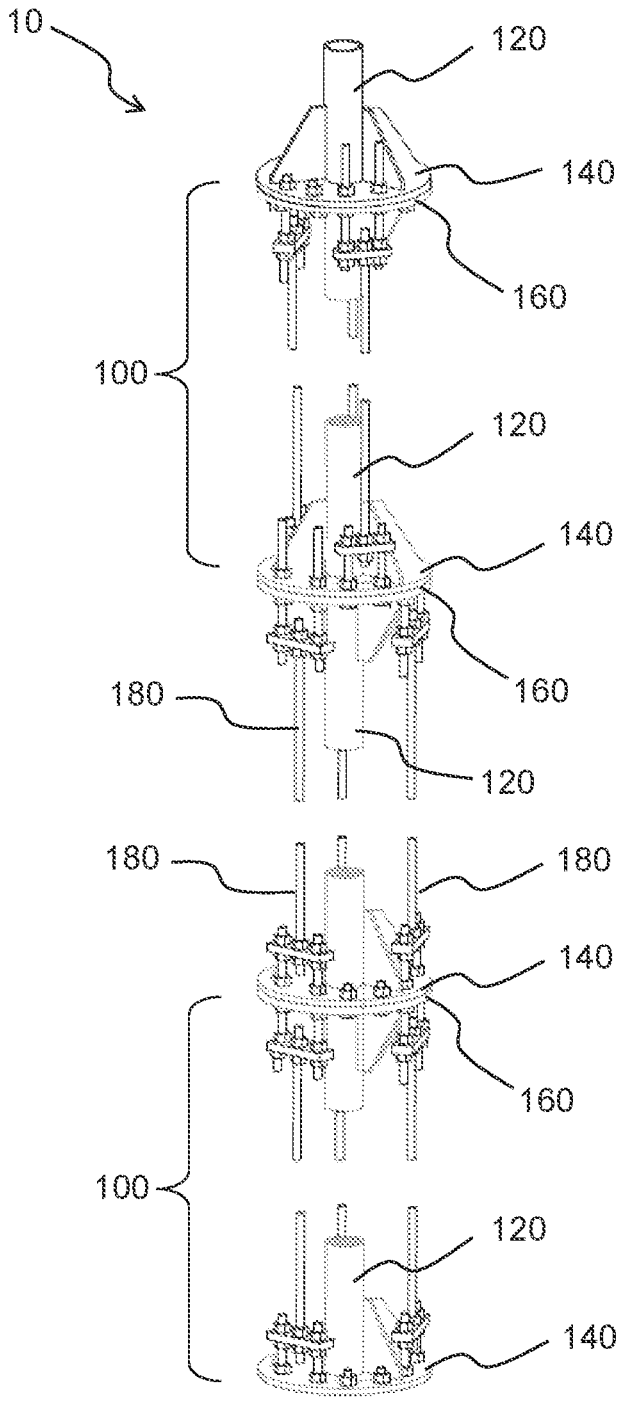
FIG. 2 is a side perspective view of a stealth pole according to an aspect of the disclosure.

Aspects of the disclosure relate to methods for reinforcing a stealth pole. With reference to FIGS. 1 and 2, the stealth pole 10 includes a plurality of canister sections 100, each of the plurality of canister sections 100 includes a spine 120, a first splice plate 140 located on a first end of the spine 120, a second splice plate 160 located on a second end of the spine 120, and a canister cover 200 that covers the spine 120, the first splice plate 140 and the second splice plate 160.

Figure 3:
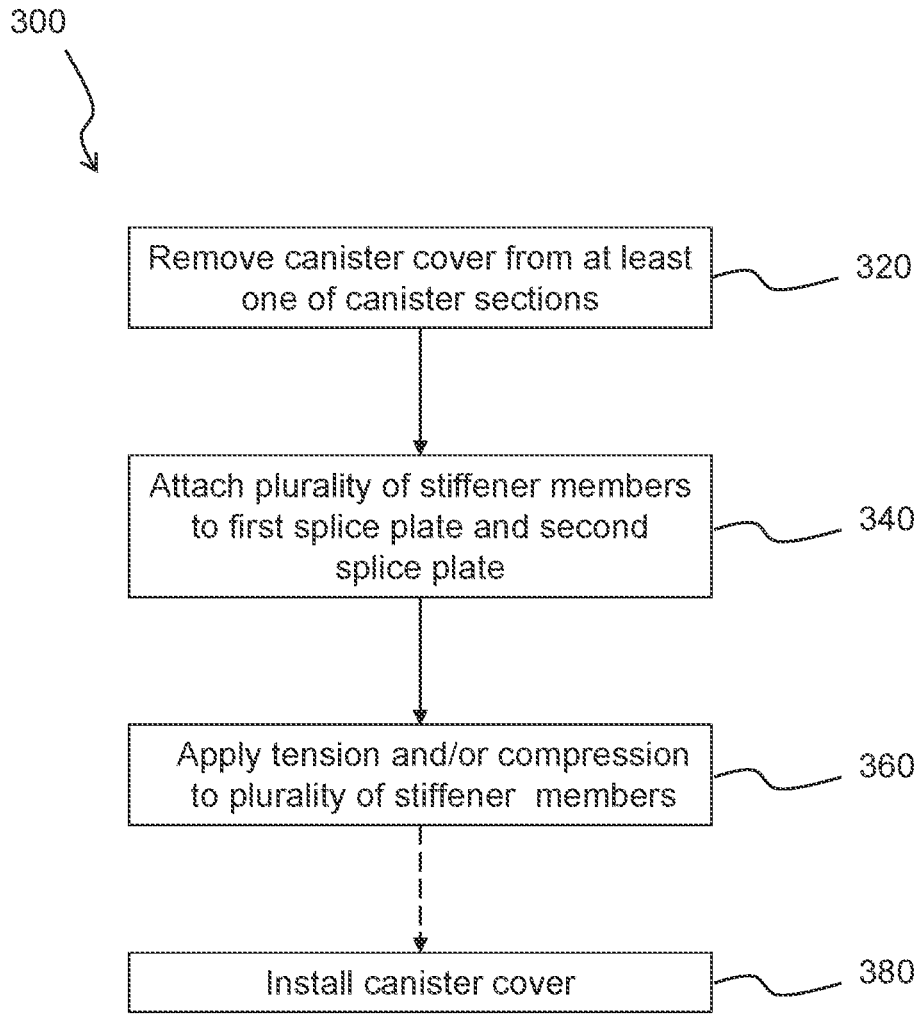
FIG. 3 illustrates a method for reinforcing a stealth pole according to an aspect of the disclosure.

As shown in FIG. 3, in an aspect the method 300 includes: removing the canister cover 200 from at least one of the plurality of canister sections 100, at step 320; attaching a plurality of stiffener members 180 to the first splice plate 140 and the second splice plate 160, at step 340; applying tension, compression or a combination thereof to the plurality of stiffener members 180, at step 360; and optionally installing a canister cover (either canister cover 200 or a different canister cover), at step 380. The plurality of stiffener members 180 reinforce the spine 120 of the canister section 100.

Figure 4:
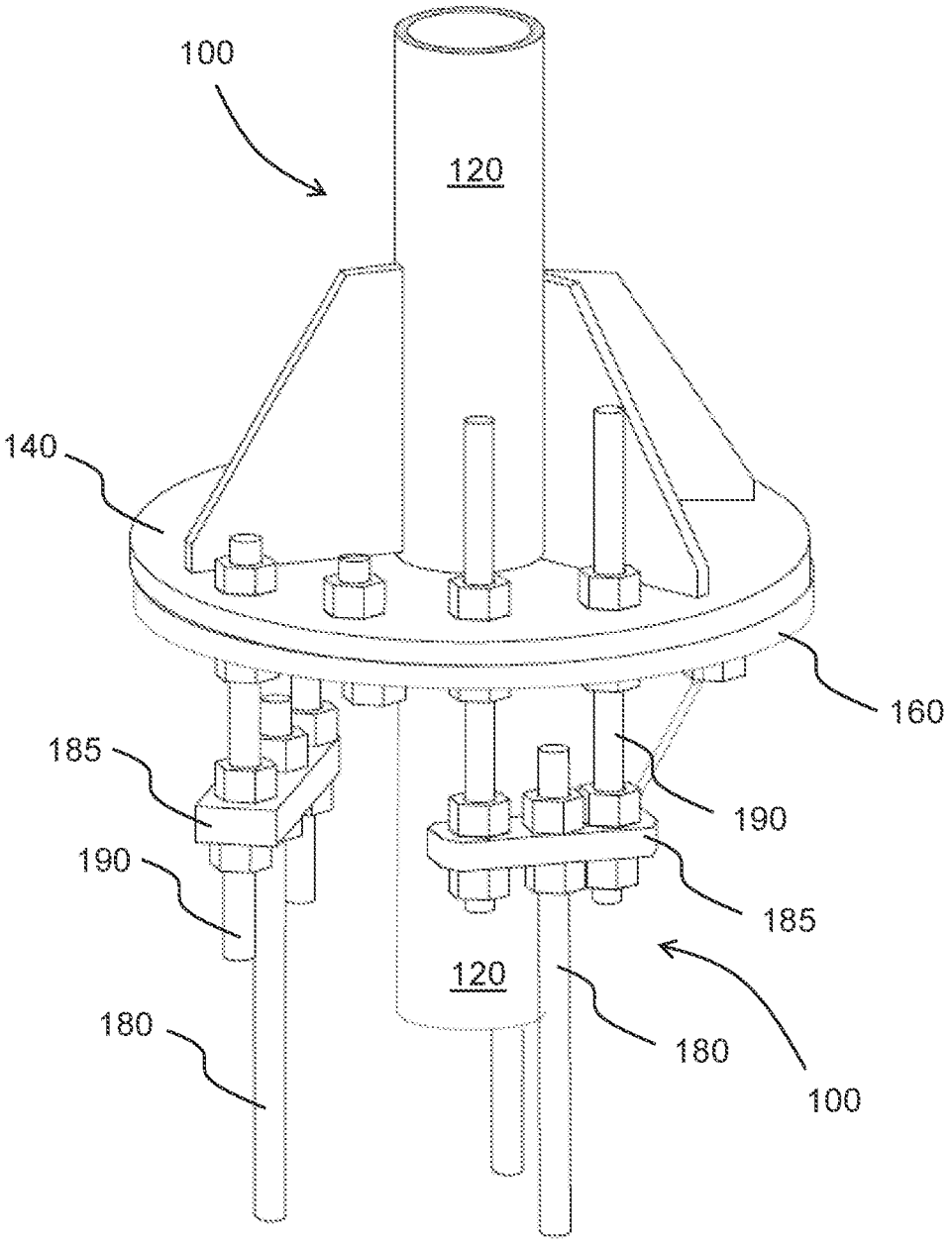
FIG. 4 is a side perspective view of a stealth pole according to an aspect of the disclosure.
Figure 5:
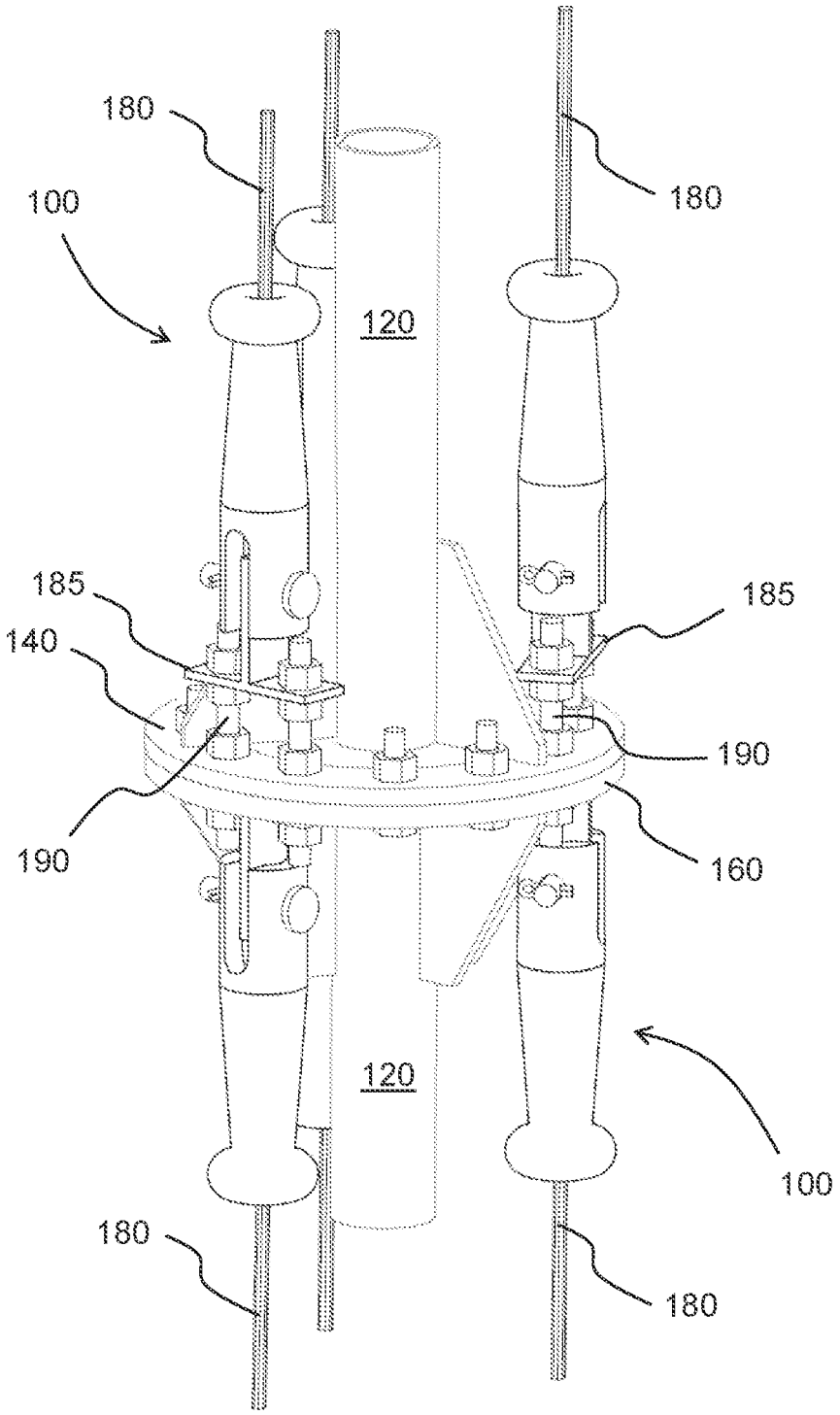
FIG. 5 is a side perspective view of a stealth pole according to an aspect of the disclosure.

Each of the plurality of stiffener members 180 may be of any form and may be formed of any material having sufficient strength to reinforce the canister section 100. Example materials include, but are not limited to, steel, carbon fiber, aramid fiber, and combinations thereof. In some aspects the plurality of stiffener members 180 include a rod, a wire, a hollow pipe, a high tenacity polymeric fiber rope (e.g., Phillystran® guy rope), a bar or a combination thereof. In a particular aspect illustrated in FIG. 4, each of the plurality of stiffener members 180 includes a rod (e.g., a 1-inch diameter solid steel rod). In a further aspect illustrated in FIG. 5, each of the plurality of stiffener members 180 includes a high tenacity polymeric fiber rope (Phillystran® guy rope).

In a particular aspect a combination of stiffener materials may be used. For example, the stiffener member could include a hollow pipe (e.g., a 2-inch Schedule 120 pipe) with a rod (e.g., a 1-inch diameter solid steel rod) inserted into the hollow pipe. One or both of the hollow pipe and the rod could be placed under tension or compression.

The step of attaching the plurality of stiffener members 180 to the first splice plate 140 and the second splice plate 160 (step 340) may be performed in numerous ways. The plurality of stiffener members 180 may be attached to the first splice plate 140 and the second splice plate with any suitable connector. In one aspect, shown in FIGS. 4 and 5, the plurality of stiffener members 180 are attached to a plate 185 (e.g., a 2-inch thick steel plate), and the plate is attached to the splice plate (140, 160) with one or more connecting rods 190 (e.g., a 1-inch thick all-thread rod).

Figure 6:
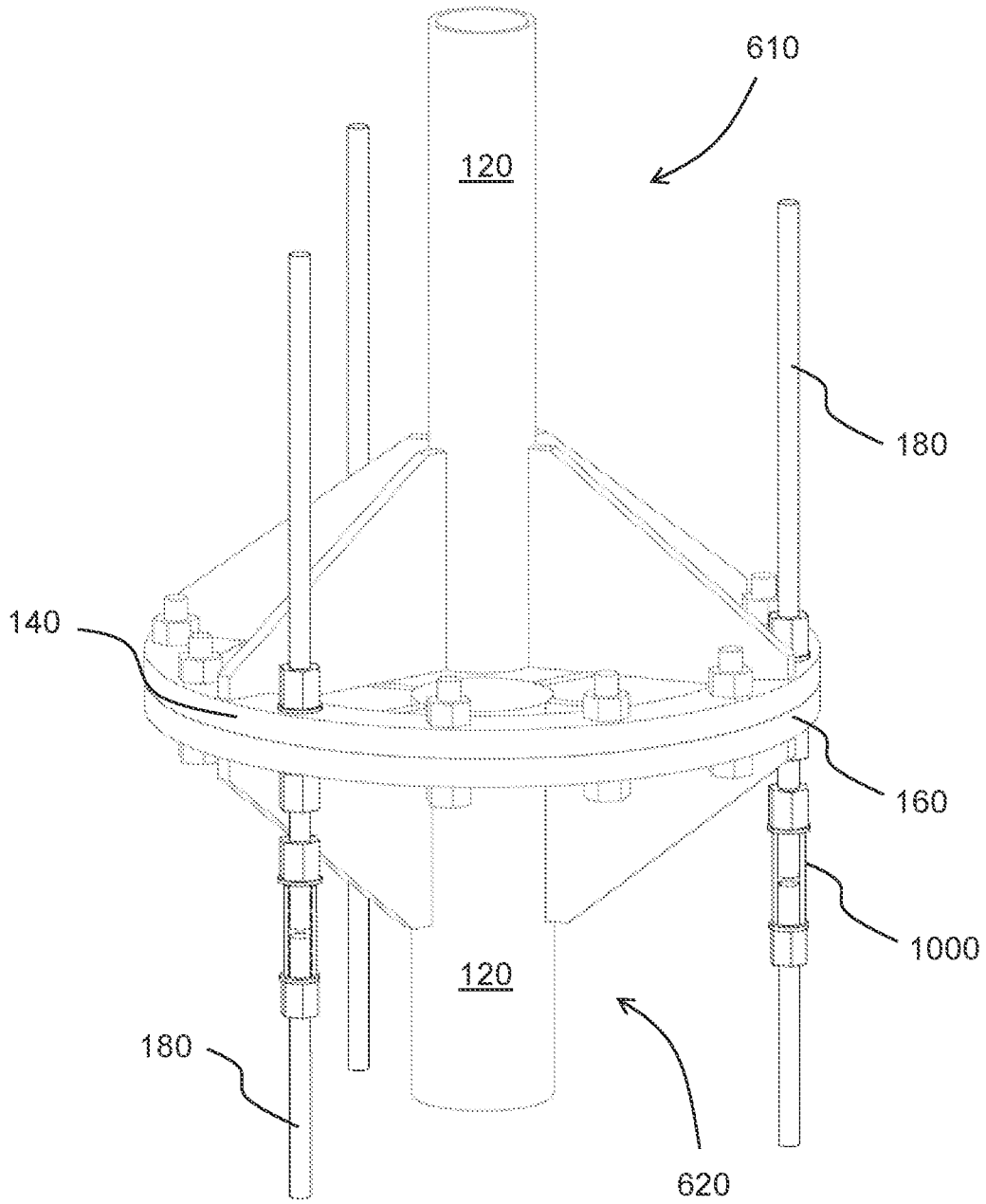
FIG. 6 is a side perspective view of a stealth pole according to an aspect of the disclosure.

In some aspects, illustrated in FIG. 6, the plurality of stiffener members 180 extend through two or more canister sections 100 so that a single stiffener member 180 reinforces a plurality of canister sections 100. Specifically, the plurality of canister sections 100 are adjacent each other on the stealth pole 10 such that the first splice plate 140 of a first canister section 610 abuts a second splice plate 160 of a second canister section 620 at an interface between the first canister section 610 and the second canister section 620, and the plurality of stiffener members 180 extend through the first splice plate 140 of the first canister section 610 and the second splice plate 160 of the second canister section 620 such that the plurality of stiffener members 180 reinforce the interface of the first canister section 610 and the second canister section 620. A coupling 1000 may be included to connect stiffener members 180 where one stiffener member 180 ends and another stiffener member 180 begins.

The steps of removing the canister cover 200 from at least one of the plurality of canister sections 100 (step 320) and the optional step of installing a canister cover (step 380) are performed by conventional methods. In some aspects the step of installing a canister cover, at 380, includes reinstalling the original canister cover removed at step 320. In other aspects the step of installing a canister cover, at 380, includes installing a different canister cover, such as a new canister cover of the same size or a canister cover of a larger size.

The step of applying tension, compression or a combination thereof to the plurality of stiffener members 180 (step 360) may include applying enough tension, compression or a combination thereof to the plurality of stiffener members 180 so that the plurality of stiffener members 180 are not loose within the canister section 100.

In some aspects, tension is applied to one or more of the plurality of stiffener members 180, the plurality of stiffener members 180 have a maximum tension capacity (dependent on the stiffener member material, type and/or size), and the tension applied to one or more of the plurality of stiffener members is from about 1% to about 5% of the maximum tension capacity. In a particular aspect one or more of the plurality of stiffener members 180 is tensioned to about 2% of the maximum tension capacity. In this manner, one or more of the plurality of stiffener members 180 are pretensioned to an extent that minimizes the stress on the plurality of stiffener members 180 when the stealth pole is not being subjected to wind conditions. There is enough tension on one or more of the plurality of stiffener members 180, however, so that when the stealth pole 10 is subjected to wind, the plurality of stiffener members 180 under tension will immediately tension further and reinforce the spine 120 of the canister section 100.

In further aspects compression is applied to one or more of the plurality of stiffener members 180, the plurality of stiffener members 180 have a maximum compression capacity (dependent on the stiffener member material, type and/or size), and the compression applied to one or more of the plurality of stiffener members is from about 1% to about 5% of the maximum compression capacity. In a particular aspect one or more of the plurality of stiffener members 180 is placed in compression to about 2% of the maximum compression capacity. Applying compression to one or more of the plurality of stiffener members 180 could in some aspects provide the stiffener member with enhanced strength and stiffness as compared to a stiffener member that is under tension or at rest (i.e., under neither tension nor compression).

In certain aspects one or more of the plurality of stiffener members 180 are placed in tension, and one or more of the plurality of stiffener members 180 are also placed in compression. In such aspects, it may be desirable to place one or more stiffener members 180 that face a direction from which the wind predominantly blows into compression, and to place one or more stiffener members 180 that face a direction away from which the wind predominantly blows into tension. In one purely exemplary aspect in which a canister section 100 includes three stiffener members 180, and in which the wind predominantly blows from the Southwest, two of the stiffener members 180 predominantly facing Southwest may be placed in compression and the one stiffener member predominantly facing Northeast may be placed in tension. In this manner, when the predominant Southwest wind blows against the stealth pole 10, the stealth pole would have a tendency to flex towards the Northeast, the stiffener members 180 in compression will absorb some of the tension force applied to the stealth pole 10 (and become less compressed or even tensioned), and the stiffener member 180 in tension on the other side of the stealth pole 10 will become less tensioned or even compressed. The net result in the shift in tension/compression is that the overall stress on the spine 120 of the canister section 100 will be reduced.

In some aspects at least one of the canister sections 100 includes a plurality of telecommunications antennas 250 (see FIG. 1) that send or receive wireless communication signals, and the plurality of stiffener members 180 are located within the canister section 100 between the plurality of telecommunications antennas 250 such that they are offset from, and do not overlie, the plurality of telecommunications antennas 250. In manner, the plurality of stiffener members 180 will not interfere with the performance of the plurality of telecommunications antennas 250 during their operation. In certain aspects, however, the plurality of stiffener members may be formed of a radiofrequency (RF) transparent material, so that they will not interfere with the performance of the plurality of telecommunications antennas 250 even if one or more of the plurality of stiffener members 180 does overlie a telecommunications antenna 250. In certain aspects the RF transparent material includes, but is not limited to, fiberglass cable, polymer cable, or a combination thereof. Exemplary polymer cables are available from Phillystran®. In some aspects the method 300 may be performed on one or more canister sections 100 that does not include telecommunications antennas 250.

Figure 7:
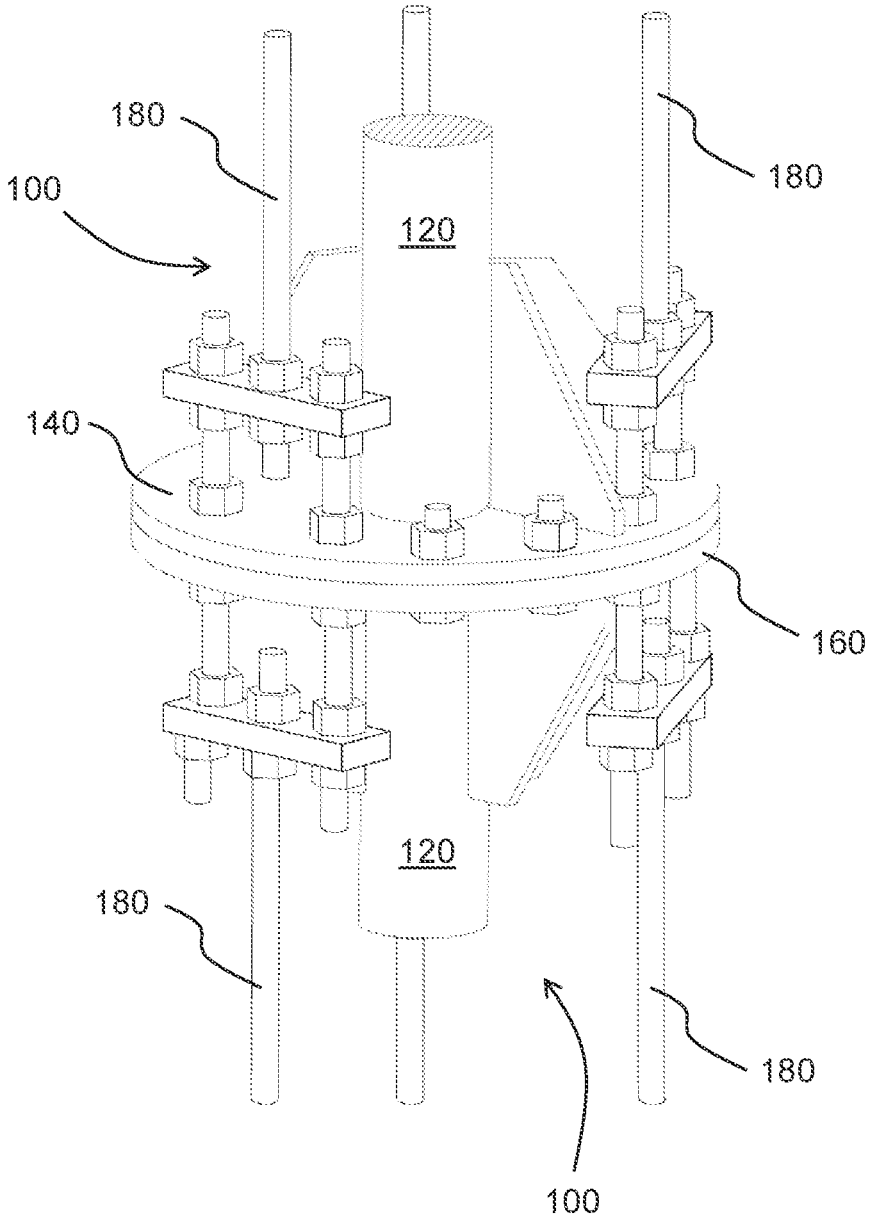
FIG. 7 is a side perspective view of a stealth pole according to an aspect of the disclosure.
Figure 8:
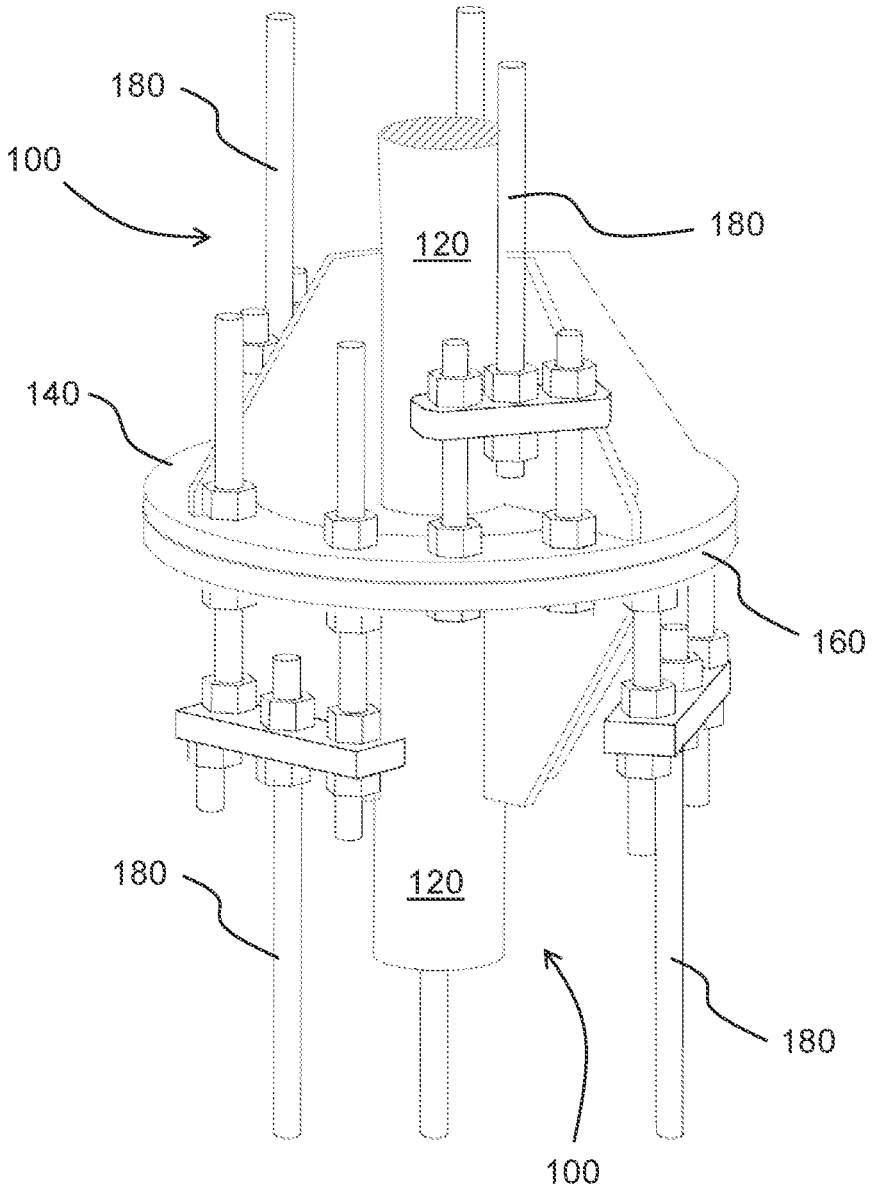
FIG. 8 is a side perspective view of a stealth pole according to an aspect of the disclosure.

In some aspects the plurality of stiffener members 180 in adjacent canister sections 100 may be aligned, as shown in FIG. 7. In other aspects, the plurality of stiffener members 180 in adjacent canister sections 100 may be offset, as shown in FIG. 8.

It will be apparent that the method 300 described herein may be performed on the stealth pole 10 without removing the plurality of telecommunications antennas 250 from the stealth pole 10. In particular, the plurality of stiffener members 180 can be installed in the canister section 100 between the plurality of telecommunications antennas 250. This allows the method 300 to be performed without taking the plurality of telecommunications antennas 250 offline, saving the Carriers time and money. Further, the method 300 may be performed without the use of a welding process. This reduces the substantial risk of equipment damage and fire due to the presence of cables in the stealth pole.

Reinforced Stealth Pole

Aspects of the disclosure further relate to a reinforced stealth pole. With reference to the above description and the figures, the stealth pole 10 includes a plurality of canister sections 100. Each of the plurality of canister sections 100 includes a spine 120, a first splice plate 140 located on a first end of the spine 120, a second splice plate 160 located on a second end of the spine 120, and a plurality of stiffener members 180 attached to the first splice plate 140 and the second splice plate 160. The plurality of stiffener members 180 are tensioned, and the plurality of stiffener members 180 reinforce the spine 120. The stealth pole may include other features, including but not limited to those described herein with respect to the method 300.

In some aspects the reinforced stealth poles 10 described herein have reduced deflection when exposed to wind-induced vortex shedding conditions as compared to a conventional stealth pole that does not include a plurality of stiffener members 180. In some aspects the plurality of stiffener members reduce deflection of the canister section by at least 20% when the stealth pole is exposed to wind-induced vortex shedding conditions. In further aspects the plurality of stiffener members reduce deflection of the canister section by at least 30% when the stealth pole is exposed to wind-induced vortex shedding conditions. In specific aspects the plurality of stiffener members reduce deflection of the canister section by at least 40% when the stealth pole is exposed to wind-induced vortex shedding conditions. In one example a deflection of about 22 feet was observed in a conventional 159 foot long stealth pole including a 119 foot long base and 4-10 foot-long canister sections attached to the base when exposed to 115 MPH winds. That same pole, when reinforced with a plurality of stiffener members in accordance with the present disclosure, deflected only about 17.2 feet when exposed to the same wind conditions. In each case deflection was measured at the top of the stealth pole.

Various combinations of elements of this disclosure are encompassed by this disclosure, e.g., combinations of elements from dependent claims that depend upon the same independent claim.

Aspects of the Disclosure

In various aspects, the present disclosure pertains to and includes at least the following aspects.

Aspect 1: A method for reinforcing a stealth pole, the stealth pole comprising a plurality of canister sections, each of the plurality of canister sections comprising a spine, a first splice plate located on a first end of the spine, a second splice plate located on a second end of the spine, and a first canister cover that covers the spine, the first splice plate and the second splice plate, the method comprising:

removing the first canister cover from at least one of the plurality of canister sections;

attaching a plurality of stiffener members to the first splice plate and the second splice plate; and applying tension, compression or a combination thereof to the plurality of stiffener members, wherein the plurality of stiffener members reinforce the spine of the canister section.

Aspect 2: The method according to Aspect 1, wherein at least one of the canister sections comprises a plurality of telecommunications antennas that send or receive wireless communication signals, and the method is performed on the stealth pole without taking the plurality of telecommunications antennas offline.

Aspect 3: The method according to Aspect 1 or 2, wherein the plurality of stiffener members comprise a rod, a wire, a high tenacity polymeric fiber rope, a bar or a combination thereof.

Aspect 4: The method according to any of Aspects 1 to 3, wherein the plurality of canister sections are adjacent each other on the stealth pole such that the first splice plate of a first canister section abuts a second splice plate of a second canister section at an interface between the first canister section and the second canister section, and the plurality of stiffener members extend through the first splice plate of the first canister section and the second splice plate of the second canister section such that the plurality of stiffener members reinforce the interface of the first canister section and the second canister section.

Aspect 5: The method according to any of Aspects 1 to 4, wherein the step of attaching the plurality of stiffener members to the first splice plate and the second splice plate is performed without a welding process.

Aspect 6: The method according to any of Aspects 1 to 5, wherein tension is applied to one or more of the plurality of stiffener members, each of the plurality of stiffener members has a maximum tension capacity, and the tension applied to one or more of the plurality of stiffener members is from about 1% to about 5% of the maximum tension capacity.

Aspect 7: The method according to Aspect 6, wherein the tension applied to one or more of the stiffener members is about 2% of the maximum tension capacity.

Aspect 8: The method according to any of Aspects 1 to 7, wherein compression is applied to one or more of the plurality of stiffener members.

Aspect 9: The method according to Aspect 8, wherein each of the plurality of stiffener members has a maximum compression capacity, and the compression applied to one or more of the plurality of stiffener members is from about 1% to about 5% of the maximum compression capacity.

Aspect 10: The method according to Aspect 9, wherein the compression applied to one or more of the compression members is about 2% of the maximum compression capacity.

Aspect 11: The method according to any of Aspects 1 to 10, wherein a combination of tension and compression are applied to the plurality of stiffener members.

Aspect 12: The method according to any of Aspects 1 to 11, wherein the plurality of stiffener members comprise a radiofrequency (RF) transparent material.

Aspect 13: The method according to any of Aspects 1 to 12, wherein at least one of the canister sections comprises a plurality of telecommunications antennas that send or receive wireless communication signals, and the plurality of stiffener members are located within the canister section between the plurality of telecommunications antennas such that they are offset from, and do not overlie, the plurality of telecommunications antennas.

Aspect 14: The method according to any of Aspects 1 to 13, wherein the plurality of stiffener members reduce deflection of the canister section by at least 20% when the stealth pole is exposed to wind-induced vortex shedding conditions.

Aspect 15: The method according to any of Aspects 1 to 14, wherein the plurality of stiffener members reduce deflection of the canister section by at least 30% when the stealth pole is exposed to wind-induced vortex shedding conditions.

Aspect 16: The method according to any of Aspects 1 to 15, wherein the plurality of stiffener members reduce deflection of the canister section by at least 40% when the stealth pole is exposed to wind-induced vortex shedding conditions.

Aspect 17: The method according to any of Aspects 1 to 16, further comprising:

reinstalling the first canister cover around the at least one of the plurality of canister sections; or installing a second canister cover around the at least one of the plurality of canister sections, wherein the second canister cover is different than the first canister cover.

Aspect 18: A stealth pole, comprising:

a plurality of canister sections, each of the plurality of canister sections comprising a spine, a first splice plate located on a first end of the spine, a second splice plate located on a second end of the spine; and a plurality of stiffener members attached to the first splice plate and the second splice plate;

wherein the plurality of stiffener members are placed in tension, compression or a combination thereof, and the plurality of stiffener members reinforce the spine.

Aspect 19: The stealth pole according to Aspect 18, wherein the plurality of stiffener members comprise a rod, a wire, a high tenacity polymeric fiber rope, a bar or a combination thereof.

Aspect 20: The stealth pole according to Aspect 18 or 19, wherein the plurality of canister sections are adjacent each other on the stealth pole such that the first splice plate of a first canister section abuts a second splice plate of a second canister section at an interface between the first canister section and the second canister section, and the plurality of stiffener members extend through the first splice plate of the first canister section and the second splice plate of the second canister section such that the plurality of stiffener members reinforce the interface of the first canister section and the second canister section.

Aspect 21: The stealth pole according to any of Aspects 18 to 20, wherein tension is applied to one or more of the plurality of stiffener members, each of the plurality of stiffener members has a maximum tension capacity, and the tension applied to one or more of the plurality of stiffener members is from about 1% to about 5% of the maximum tension capacity.

Aspect 22: The stealth pole according to any of Aspects 18 to 21, wherein compression is applied to one or more of the plurality of stiffener members Aspect 23: The stealth pole according to Aspect 22, wherein each of the plurality of stiffener members has a maximum compression capacity, and the compression applied to one or more of the plurality of stiffener members is from about 1% to about 5% of the maximum compression capacity.

Aspect 24: The stealth pole according to Aspect 23, wherein the compression applied to one or more of the compression members is about 2% of the maximum compression capacity.

Aspect 25: The stealth pole according to any of Aspects 18 to 24, wherein a combination of tension and compression are applied to the plurality of stiffener members.

Aspect 26: The stealth pole according to any of Aspects 18 to 25, wherein the plurality of stiffener members comprise a radiofrequency (RF) transparent material.

Aspect 27: The stealth pole according to any of Aspects 18 to 26, wherein at least one of the canister sections comprises a plurality of telecommunications antennas that send or receive wireless communication signals, and the plurality of stiffener members are located within the canister section between the plurality of telecommunications antennas such that they are offset from, and do not overlie, the plurality of telecommunications antennas.

Aspect 28: The stealth pole according to any of Aspects 18 to 27, wherein the plurality of stiffener members reduce deflection of the canister section by at least 20% when the stealth pole is exposed to wind-induced vortex shedding conditions.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary and are not intended to limit the disclosure. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric. Unless indicated otherwise, percentages referring to composition are in terms of wt %.

In the Example, manual calculations of simulations for three different stiffener member configurations for a canister section of a stealth pole were performed:

(C) a comparative unreinforced canister section having only a spine and no stiffener members;

(E1) a canister section including three stiffener members arranged 120 degrees apart, the stiffener members placed in tension; and (E2) a canister section including three stiffener members arranged 120 degrees apart, with two stiffener members on the wind-facing side loaded in compression and the one stiffener member on the back-side loaded in tension.

The materials used in each simulation are described in Table 1 below. Wind having a speed of 90 miles per hour (MPH) was applied to each canister section. For example E2, the wind force was applied from the direction that predominantly faced the two stiffener members in compression. Stress on the spine of the canister section (i.e., structural usage) was evaluated for each example; results are shown in Table 1:

TABLE 1

| Example | Materials | Tension/ Compression on Stiffener Members | Structural Usage on Stiffener Members with 90 MPH wind | Structural Usage on Spine with 90 MPH wind |
|---|---|---|---|---|
| C | Spine: 4.5-inch (in.) solid rod Stiffener Members (SM): none | N/A | N/A | 168% |
| E1 | Spine: 4.5 in solid rod | Tension: 81.9 Kilo-pound force (Kips) each | 0% for two SMs facing towards wind | 85% |
| | SM: 1 in. Williams Rebar | | 152% for one SM facing away from wind | |
| E2 | Spine: 4.5 in solid rod | Compression (two SMs): 33.8 Kips each | 41% for SMs initially in compression facing towards wind | 41% |
| | SM: 2 in. Schedule 120 hollow pipe | Tension (one SM): 68.3 Kips | 68% for SM initially in tension facing away from wind | |

As can be seen from the simulations, when exposed to a wind force the unreinforced spine (C) was stressed to 168% of its initial value (i.e., the structural usage on the spine was at 168%). Structural usage for the spine in E1 having three stiffener members initially only in tension was lower at 85%, and structural usage for the spine in E2 having two stiffener members facing the wind initially in compression and one stiffener member facing away from the wind initially in tension was much lower at 41%. In addition, the structural usage of the three stiffener members in E2 were all below 100%-41% for stiffener members facing the wind (initially in compression) and 68% for the stiffener member facing away from the wind (initially in tension). Thus, the maximum stress in each of the components of the simulated canister section (spine and stiffener members) is lower in E2 than in E1 and the comparative example (C).

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

That which is claimed is:

1. A stealth pole, comprising:

at least a first canister section and a second canister section, wherein the first canister section comprises a first spine, a first splice plate located on a first end of the first spine and a second splice plate located on a second end of the first spine, and wherein the second canister section comprises a second spine, a third splice plate located on a first end of the second spine and a fourth splice plate located on a second end of the second spine;

a plurality of stiffener members attached to the first splice plate and the second splice plate of the first canister section;

a plurality of telecommunications antennas that send or receive wireless communication signals located within at least the first canister section; and a canister cover corresponding to the first canister section, wherein the canister cover covers the first spine, the first splice plate, the second splice plate, and the plurality of telecommunications antennas, wherein the plurality of stiffener members are placed in tension, compression or a combination thereof, and the plurality of stiffener members reinforce the first spine.

2. The stealth pole of claim 1, wherein the plurality of stiffener members comprise a rod, a wire, a high tenacity polymeric fiber rope, a bar or a combination thereof.

3. The stealth pole of claim 1, wherein the first and second canister sections are adjacent each other on the stealth pole such that the second splice plate of the first canister section abuts the third splice plate of the second canister section at an interface between the first canister section and the second canister section, and the plurality of stiffener members extend through the second splice plate of the first canister section and the third splice plate of the second canister section such that the plurality of stiffener members reinforce the interface of the first canister section and the second canister section.

4. The stealth pole of claim 1, wherein tension is applied to one or more of the plurality of stiffener members, each of the plurality of stiffener members has a maximum tension capacity, and the tension applied to one or more of the plurality of stiffener members is from about 1% to about 5% of the maximum tension capacity.

5. The stealth pole of claim 1, wherein compression is applied to one or more of the plurality of stiffener members, each of the plurality of stiffener members has a maximum compression capacity, and the compression applied to one or more of the plurality of stiffener members is from about 1% to about 5% of the maximum compression capacity.

6. The stealth pole of claim 5, wherein a combination of tension and compression are applied to the plurality of stiffener members.

7. The stealth pole of claim 1, wherein the plurality of stiffener members are located within the canister section between the plurality of telecommunications antennas such that they are offset from, and do not overlie, the plurality of telecommunications antennas.

8. The stealth pole of claim 1, wherein the plurality of stiffener members reduce deflection of the canister section by at least 20% when the stealth pole is exposed to wind-induced vortex shedding conditions.

* * * * *